US008331835B2

(12) United States Patent
Hirayama et al.

(10) Patent No.: US 8,331,835 B2
(45) Date of Patent: Dec. 11, 2012

(54) DEVELOPING DEVICE AND IMAGE FORMING APPARATUS WITH DEVELOPER INCLUDING TONER, CARRIER, AND REVERSE POLARITY PARTICLES

(75) Inventors: Junya Hirayama, Takarazuka (JP); Toshiya Natsuhara, Takarazuka (JP); Takeshi Maeyama, Ikeda (JP); Shigeo Uetake, Takatsuki (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 1039 days.

(21) Appl. No.: 12/074,650

(22) Filed: Mar. 5, 2008

(65) Prior Publication Data

US 2008/0219712 A1 Sep. 11, 2008

(30) Foreign Application Priority Data

Mar. 8, 2007 (JP) ..... JP2007-058506

(51) Int. Cl.
*G03G 15/08* (2006.01)

(52) U.S. Cl. ..... 399/281; 399/283; 399/285

(58) Field of Classification Search ..... 399/281, 399/283, 285
See application file for complete search history.

(56) References Cited

U.S. PATENT DOCUMENTS

| | | | | |
|---|---|---|---|---|
| 5,255,057 | A | 10/1993 | Stelter et al. | |
| 5,832,350 | A * | 11/1998 | Kumasaka et al. | 399/282 |
| 5,991,587 | A | 11/1999 | Kikuchi | |
| 6,272,296 | B1 * | 8/2001 | Gartstein | 399/55 |
| 6,353,720 | B1 * | 3/2002 | Sakai et al. | 399/234 |
| 6,512,909 | B2 | 1/2003 | Ozawa et al. | |
| 6,721,516 | B2 | 4/2004 | Aoki et al. | |
| 6,743,559 | B2 * | 6/2004 | Combes et al. | 430/123.56 |
| 7,968,267 | B2 * | 6/2011 | Maeyama et al. | 430/123.58 |
| 7,986,892 | B2 * | 7/2011 | Maeyama et al. | 399/55 |
| 8,095,026 | B2 * | 1/2012 | Maeyama et al. | 399/55 |
| 8,126,378 | B2 * | 2/2012 | Uetake et al. | 399/270 |
| 8,131,191 | B2 * | 3/2012 | Hirayama et al. | 399/281 |
| 2002/0061207 | A1 * | 5/2002 | Hirabayashi et al. | 399/175 |
| 2006/0133858 | A1 * | 6/2006 | Hirayama et al. | 399/273 |
| 2007/0212122 | A1 * | 9/2007 | Maeyama et al. | 399/267 |

(Continued)

FOREIGN PATENT DOCUMENTS

| | | |
|---|---|---|
| JP | 59-100471 | 6/1984 |
| JP | 59-100471 A | 6/1984 |

(Continued)

OTHER PUBLICATIONS

European Search Report mailed on Aug. 30, 2012 for corresponding European Patent Application No. 08 00 4032.

*Primary Examiner* — David Gray
*Assistant Examiner* — Geoffrey Evans
(74) *Attorney, Agent, or Firm* — Brinks Hofer Gilson & Lione

(57) ABSTRACT

An image forming apparatus provided with an image carrying member to carry an electrostatic latent image, a toner carrying member to develop the electrostatic latent image on the image carrying member with toner; a first developer carrying member to carry developer containing toner, carrier, reverse polarity particles and to supply toner to the toner carrying member; and a second developer carrying member to carry developer and to recover toner on the toner carrying member, wherein an ability to move the reverse polarity particles from the toner carrying member to the first developer carrying member is larger than an ability to move the reverse polarity particles from the second developer carrying member to the toner carrying member.

12 Claims, 2 Drawing Sheets

U.S. PATENT DOCUMENTS

| | | | | |
|---|---|---|---|---|
| 2009/0103957 | A1* | 4/2009 | Hirayama et al. | 399/285 |
| 2009/0252513 | A1* | 10/2009 | Maeyama et al. | 399/55 |
| 2009/0285597 | A1* | 11/2009 | Uetake et al. | 399/100 |

FOREIGN PATENT DOCUMENTS

| | | | |
|---|---|---|---|
| JP | 09-185247 | | 7/1997 |
| JP | 10-340003 | | 12/1998 |
| JP | 10-340003 | A | 12/1998 |
| JP | 2000-298396 | | 10/2000 |
| JP | 2002-108104 | | 4/2002 |
| JP | 2003-057882 | | 2/2003 |
| JP | 2003-215855 | | 7/2003 |
| JP | 2003-215855 | A | 7/2003 |
| JP | 2005-189708 | | 7/2005 |

* cited by examiner

DEVELOPING DEVICE AND IMAGE FORMING APPARATUS WITH DEVELOPER INCLUDING TONER, CARRIER, AND REVERSE POLARITY PARTICLES

This application is based on Japanese Patent Application No. 2007-058506 filed on Mar. 8, 2007, in Japanese Patent Office, the entire content of which is hereby incorporated by reference.

BACKGROUND OF THE INVENTION

The present invention relates to a developing device and an image forming apparatus which develop a latent image on an image carrying member with developer containing toner and carrier.

Conventionally, as a developing method for an electrostatic latent image formed on an image carrying member in an image forming apparatus employing an electrophotography-ing technique, there have been well known the one component type developing method using only toner as developer and the two component type developing method using toner and carrier.

Generally, in the one component type developing method, toner is electrically charged when passing a regulating section formed with a toner carrying member and a regulating plate being pressed onto the toner carrying member, and the toner forms a desired toner thin layer and develops an electrostatic latent image. For this reason, since the developing is conducted on the condition where the toner carrying member and the image carrying member are arranged to be adjacent to each other, the reproducibility of dot becomes excellent. Further, when a uniform toner thin layer is formed, a uniform image may be easily obtained without unevenness of an image which is caused by magnetic brush and observed in the two component type developing method. Further, it has been considered that the one component type developing method is advantageous in respect of making an apparatus simpler, smaller, and with lower cost. However, on the other hand, the quality of the surface of toner alters with a strong stress in a regulating section and the electric charge receptiveness of the toner decreases. Then, a toner regulating member and the surface of a toner carrying member are polluted with adhesion of toner or an external additive, and a electrically charging ability for toner reduces, thereby causing a problem of fogging or soil at an inside of an apparatus by poorly charged toner. As a result, there may be a problem that the life of a developing device becomes shorter.

On the other hand, in the two component type developing method, since toner is electrically charged with triboelectrification when the toner is mixed with carrier, stress applied to toner is smaller. Therefore, the two component type developing method is advantageous in respect of degradation of toner. Furthermore, since the carrier being a charge providing member for toner has a larger surface area, the two component type developing method relatively hardly causes pollution by toner or an external additive, and is advantageous in respect of extension of life-span.

However, when two component developer is used, there may be no change in that pollution on the surface of carrier is caused by toner or an external additive. The usage over a long period of time causes lowering of an electrically charged amount of toner, thereby further causing problems, such as fog and toner scattering. Accordingly, it can be said that its life is by no means enough, and then extension of life-span is desired more.

As a method of extending the life-span of two component developer, Patent documents 1 discloses a developing device to replenish a small amount of carrier independently or together with toner for each time; and to discharge deteriorated developer having a decreased electrically chargeable ability in accordance with the replenishment so as to replace carrier; thereby suppressing increase of the ratio of deteriorated carrier. In this device, since carrier is replaced, it becomes possible to suppress decrease of an electrically charged amount of toner due to the deterioration of carrier at a predetermined level, and this technique is advantageous to extension of life-span.

Moreover, Patent documents 2 discloses two component developer composed of carrier and toner externally added with particles having an electrically chargeable property with a reverse polarity against the electrically charged polarity of the toner and a developing method using this two component developer. In this developing method, the reverse polarity chargeable particles are added with a target for the action as abrasive powder and spacer particles, and it is shown that the effect to remove spent materials on the surface of carrier further causes an effect to suppress deterioration. Furthermore, it is reported that in the cleaning section of an image carrying member, there is an improvement in cleaning ability and an effects in polishing for an image carrying member.

Moreover, Patent document 3 discloses a so-called hybrid type developing method in which only toner of two component developers is made to be carried on a toner carrying member arranged to oppose to an image carrying member and a latent image on the image carrying member is developed with the toner. The hybrid type developing method has the following features which are not in the ordinary two component developing method. Unevenness of an image caused by a magnetic brush does not occur, and it is excellent in dot reproducibility or evenness of an image. Since a magnetic brush is not brought in direct contact with an image carrying member, shift (carrier consumption) of carrier to an image carrying member does not take place. Further, with a structure having a recovery developer carrying member for recovering toner from a toner carrying member after development, a counter measure is taken for a problem of an image memory phenomenon in which a previous image pattern is reflected to the following image. In the hybrid type developing method, since electrically charging for toner is performed by triboelectrification with carrier, maintenance of the charge providing ability of carrier is important in order to stabilize the electrically-charged ability of toner and to maintain a good image quality over a long period of time.

[Patent documents 1] Japanese Patent Unexamined Publication No. 59-100471 Official gazette

[Patent documents 2] Japanese Patent Unexamined Publication No. 2003-215855 Official gazette

[Patent documents 3] Japanese Patent Unexamined Publication No. 10-340003 Official gazette However, in Patent documents 1, there are following problems: It is necessary to provide a device to recover the discharged carrier. Since carrier becomes consumable goods, there are problems in cost and an environmental aspect. Moreover, until old and new ratio of carrier becomes stabilized, it is necessary to repeat printing of predetermined amount, and it is not necessarily possible to maintain an early characteristic. Further, in Patent document 2, there is a problem that since the consumption of toner and reverse polarity chargeable particles varies in accordance with imaging area ratios, when an imaging area ratio is small, the consumption of the reverse polarity chargeable particles adhering to a non-imaging area having a large area becomes superfluous, and then an effect to suppress deterioration of carrier exiting in a developing device decreases. Furthermore, in the hybrid type developing method of Patent documents 3, there was a problem that the surface of carrier was polluted with toner, a post treatment agent and so on with increase of the number of printed sheets, resulting in that the charge providing ability of the carrier decreases.

SUMMARY OF THE INVENTION

In a developing device employing two component developer, an object of the present invention is to provide the developing device and image forming apparatus which can perform good image formation for a long period of time without an image memory phenomenon by preventing carrier deterioration.

In order to solve the above-mentioned problem, the present invention has the following features.

Item 1. An image forming apparatus, comprises:

an image carrying member to carry an electrostatic latent image;

a developer container to accommodate developer containing toner, carrier to electrically charge the toner, reverse polarity particles electrically chargeable with a reverse polarity against the electrically charged polarity of the toner;

a toner carrying member to carry toner to a developing region arranged opposite to the image carrying member in order to develop the electrostatic latent image on the image carrying member with the toner;

a first developer carrying member arranged opposite to the toner carrying member so as to carry developer fed from the developer container and to supply toner to the toner carrying member; and a second developer carrying member arranged opposite to the toner carrying member at a position of an upstream side of the first developer carrying member in terms of the toner conveying direction of the toner carrying member so as to carry developer and to recover toner on the toner carrying member;

wherein an ability to move the reverse polarity particles from the toner carrying member to the first developer carrying member is larger than an ability to move the reverse polarity particles from the second developer carrying member to the toner carrying member.

Item 2. In the image forming apparatus described in Item 1, each of the first developer carrying member and the second developer carrying member includes a magnet therein and the carrier has magnetism so as to be held by the first developer carrying member and the second developer carrying member.

Item 3. In the image forming apparatus described in Item 1, the number average particle size of the reverse polarity particles is 100 nm to 1000 nm.

Item 4. In the image forming apparatus described in Item 1, the image forming apparatus further comprises:

a replenishing device to replenish toner added externally with reverse polarity particles to the developer container.

Item 5. In the image forming apparatus described in Item 1, the image forming apparatus further comprises:

a first voltage applying section to apply a first alternate voltage between the toner carrying member and the first developer carrying member; and a second voltage applying section to apply a second alternate voltage between the toner carrying member and the second developer carrying member.

Item 6. In the image forming apparatus described in Item 5, the image forming apparatus satisfies the following formula:

$$(C1\times V1pp\times d1\times f1)/(C2\times V2pp\times d2\times f2)>1$$

where C1 represents an electrostatic capacitance on the condition where there is no developer between the toner carrying member and the first developer carrying member;

V1pp represents the absolute value of a difference between the maximum value and the minimum value of the first alternate voltage;

f1 represents the frequency of the first alternate voltage;

d1 represents the shortest distance between the toner carrying member and the first developer carrying members;

C2 represents an electrostatic capacitance on the condition where there is no developer between the toner carrying member and the second developer carrying members;

V2pp represents the absolute value of a difference between the maximum value and the minimum value of the second alternate voltage;

f2 represents the frequency of the second alternate voltage; and d2 represents the shortest distance between the toner carrying member and the second developer carrying members.

Item 7. In the image forming apparatus described in Item 1, the image forming apparatus further comprises:

a first voltage applying section to apply an alternate voltage between the toner carrying member and the first developer carrying member; and a second voltage applying section to apply a direct current voltage between the toner carrying member and the second developer carrying member.

Item 8. In the image forming apparatus described in Item 1, the image forming apparatus further comprises:

a first voltage applying section to apply a first direct current voltage between the toner carrying member and the first developer carrying member in a direction to supply toner to the toner carrying member; and a second voltage applying section to apply a second direct current voltage between the toner carrying member and the second developer carrying member in a direction to recovery toner to the second developer carrying member.

Item 9. In the image forming apparatus described in Item 8, the image forming apparatus satisfies the following formula:

$$(C1\times V1)/(C2\times V2)>1$$

where C1 represents an electrostatic capacitance on the condition where there is no developer between the toner carrying member and the first developer carrying members;

V1 represents a voltage difference between the toner carrying member and the first developer carrying members;

C2 represents an electrostatic capacitance on the condition where there is no developer between the toner carrying member and the second developer carrying members; and V2 represents a voltage difference between the toner carrying member and the second developer carrying members.

Item 10. An image forming method, comprises the steps of:

accommodating developer containing toner, carrier to electrically charge the toner, reverse polarity particles electrically chargeable with a reverse polarity against the electrically charged polarity of the toner in a developer container;

forming an electrostatic latent image on an image carrying member;

holding the developer accommodated in the developer container on a first developer carrying member and conveying the developer to a supply region arranged opposite to a toner carrying member;

supplying toner from the developer held on the first developing carrying member on the supply region while moving reverse polarity particles existing on the toner carrying member to the first developer carrying member;

conveying the toner supplied onto the toner carrying member on the supply region to a development region arranged opposite to the image carrying member and developing the electrostatic latent image on the image carrying member with toner;

conveying the toner which is held on the toner carrying member and has passed through the development region, to a recovery region arranged opposite to a second developer carrying member, and recovering the toner held on the toner carrying member onto the second developer carrying member on the recovery region while moving reverse polarity particles existing on the second developer carrying member to the toner carrying member;

wherein an ability to move the reverse polarity particles from the toner carrying member to the first developer carrying member is larger than an ability to move the reverse polarity particles from the second developer carrying member to the toner carrying member.

Item 11. In the developing method described in Item 10, the developing method further comprises the steps of:

applying a first alternate voltage between the toner carrying member and the first developer carrying member; and applying a second alternate voltage between the toner carrying member and the second developer carrying member;

wherein the image forming methods satisfies the following formula:

$$(C1\times V1pp\times d1\times f1)/(C2\times V2pp\times d2\times f2)>1$$

where C1 represents an electrostatic capacitance on the condition where there is no developer between the toner carrying member and the first developer carrying member;

V1pp represents the absolute value of a difference between the maximum value and the minimum value of the first alternate voltage;

f1 represents the frequency of the first alternate voltage;

d1 represents the shortest distance between the toner carrying member and the first developer carrying members;

C2 represents an electrostatic capacitance on the condition where there is no developer between the toner carrying member and the second developer carrying members;

V2pp represents the absolute value of a difference between the maximum value and the minimum value of the second alternate voltage;

f2 represents the frequency of the second alternate voltage; and d2 represents the shortest distance between the toner carrying member and the second developer carrying members.

Item 12. In the developing method described in Item 10, the developing method further comprises the steps of:

applying an alternate voltage between the toner carrying member and the first developer carrying member; and applying a direct current voltage between the toner carrying member and the second developer carrying member.

Item 13. In the developing method described in Item 10, the developing method further comprises the steps of:

applying a first direct current voltage between the toner carrying member and the first developer carrying member in a direction to supply toner to the toner carrying member; and applying a second direct current voltage between the toner carrying member and the second developer carrying member in a direction to recovery toner to the second developer carrying member;

wherein the image forming method satisfies the following formula:

$$(C1\times V1)/(C2\times V2)>1$$

where C1 represents an electrostatic capacitance on the condition where there is no developer between the toner carrying member and the first developer carrying members;

V1 represents a voltage difference between the toner carrying member and the first developer carrying members;

C2 represents an electrostatic capacitance on the condition where there is no developer between the toner carrying member and the second developer carrying members; and V2 represents a voltage difference between the toner carrying member and the second developer carrying members.

According to the present invention, developer containing reverse polarity particles chargeable to a reverse polarity to the electrically charged polarity of toner is used as developer, a developing device is provided with a toner carrying member, a supply-developer carrying member and a recovery-developer carrying member, and an ability to supply toner to a toner carrying member from a supply-developer carrying member is made a larger value than an ability to recover toner from the toner carrying member to a recovery-developer carrying member. In this way, toner remaining on the toner carrying member after development can be recovered by the recovery-developer carrying member, and the reverse polarity particles which shift to the side of the toner carrying member side at the time of this recovery can be fully recovered by the supply-developer carrying member. Namely, an image memory phenomenon can be avoided by the action that the recovery-developer carrying member recovers toners, and, the consumption of the reverse polarity particles from the developing device can be suppressed by the action that the supply-developer carrying member fully recovers the reverse polarity particles, whereby since the reverse polarity particles can be made to always exist sufficiently in developer, effective adhesion of the reverse polarity particles onto the surface of carrier in during printing can be realized. As a result, an image memory phenomenon can be avoided, and over a long period of time, carrier deterioration can be suppressed and the stabilization of an electrically charged amount of toner can be realized. Therefore, it is possible to provide a developing device and image forming apparatus which have a long life and can perform good image formation.

DETAILED DESCRIPTION OF THE PREFERRED EMBODIMENT

An embodiment of the present invention is described with reference to the drawings.

Figure 1:
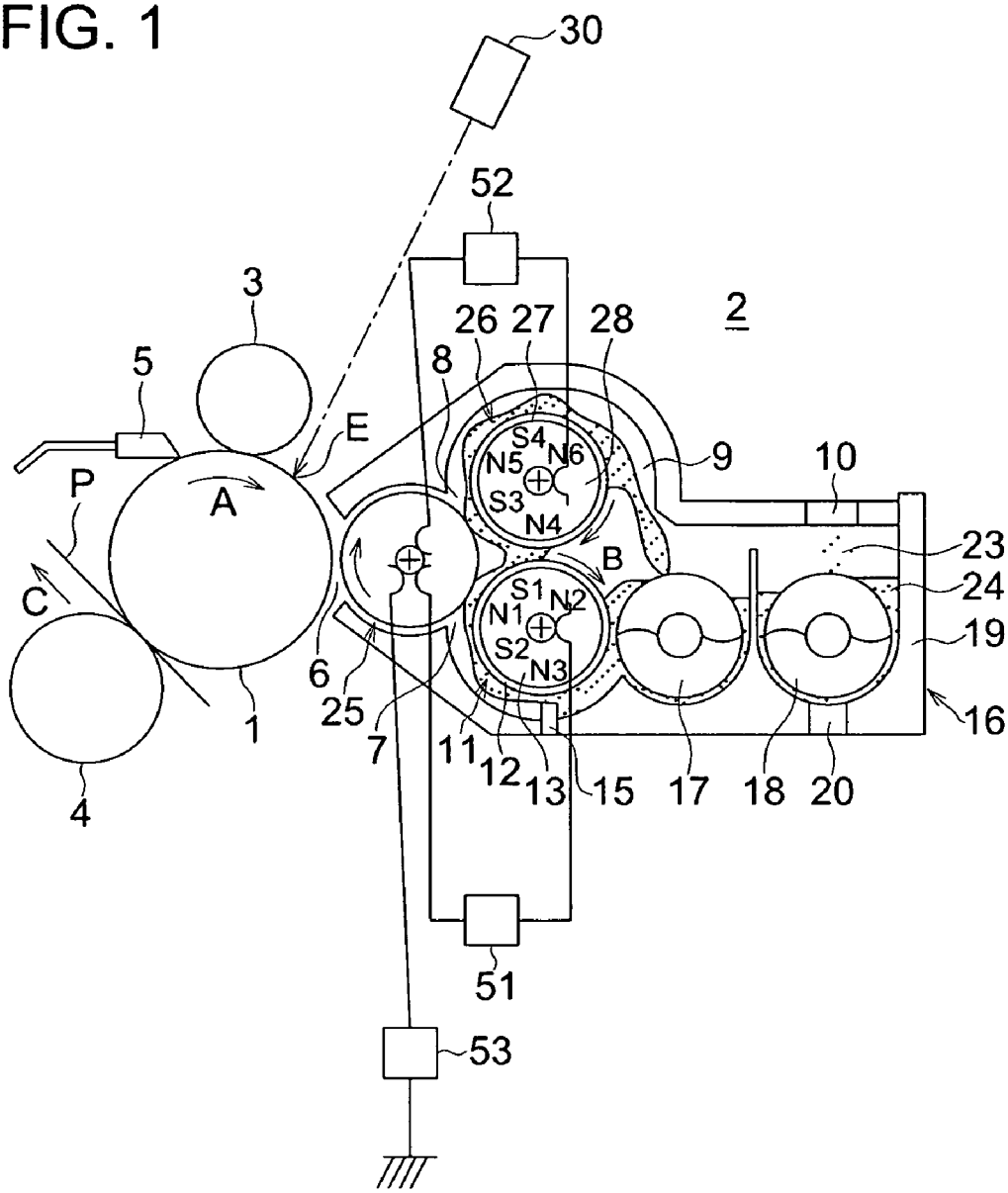
FIG. 1 is an outlined schematic diagram showing a principal part of an image forming apparatus and a developing device by one embodiment according to the present invention.

A principal part of an image forming apparatus by one embodiment of the present invention is shown in FIG. 1. This image forming apparatus is a printer which performs an image formation such that a toner image is formed on an image carrying member (photoreceptor) 1 with an electrophotographying technique and is transferred to a transfer media P, such as a sheet. This image forming apparatus comprises the image carrying member 1 for carrying an image, and around the image carrying member 1, a charging member 3 to electrically charge the image carrying member 1; a developing device 2 to develop an electrostatic latent image on the image carrying member 1; a transfer roller 4 to transfer a toner image on the image carrying member 1; and a cleaning blade 5 to remove residual toner on the image carrying member 1 are arranged in this order along a rotating direction A of the image carrying member 1.

In the image carrying member 1, a photosensitive layer is formed on the surface of the grounded substrate. After this photosensitive layer is charged by the charging member 3, the photosensitive layer is exposed by a light exposing device 30 equipped with a laser emitting device at a location of E point in the figure, whereby an electrostatic latent image is formed on that surface. The developing device 2 develops this electrostatic latent image to a toner image. The transfer roller 4 transfers this toner image on the image carrying member 1 to a transfer medium P, thereafter the transfer medium P is discharged in the direction indicated with an arrow mark C in the figure. The cleaning blade 5 removes residual toner remaining on the image carrying member 1 by a mechanical force after the transferring. Well-known technique in the electrophotographying system may be applied arbitrarily to the image carrying member 1, the charging member 3, the light exposing device 30, the transfer roller 4, and the cleaning blade 5 which are used for the image forming apparatus. For example, a charging device arranged to be in non-contact with the image carrying member 1 may be used instead of a charging roller shown the FIG. 1. Further, for example, the cleaning blade may not be used.

The developing device 2 of this embodiment comprises a toner carrying member 25 arranged to oppose the image carrying member 1 carrying an electrostatic latent image and to carry toner on its surface; a developer container 16 to accommodate developer 24; a supply-developer carrying member 11 as the first developer carrying member to carry and convey on its surface the developer 24 fed from this developer container 16 and to supply toner to the toner carrying member 25; and a recovery-developer carrying member 26 as the second developer carrying member to recover toner from the toner carrying member 25 after development. Moreover, in this embodiment, the setting conditions of each structural element of the developing device 2 are set such that the ability to move the reverse polarity particles to the side of the supply-developer carrying member 11 in a toner feed region 7 between the toner carrying member 25 and the supply-developer carrying member 11 is made larger than the ability to move the reverse polarity particles to the side of the toner carrying member 25 in a toner recovering region 8 between the toner carrying member 25 and the recovery-developer carrying member 26.

With the above setting, it is possible to eliminate an image pattern on the toner carrying member after the development in which the image pattern may cause a problem of an image memory phenomenon in a hybrid developing method. Further, the reverse polarity particles charged reversely to the charged polarity of toner can fully be collected by the supply-developer carrying member, and then can be recovered to the developer container 16. Thus, since the consumption of the reverse polarity particles to the outside of the developing device can be reduce, lowering of an electrically charged amount of toner due to carrier degradation, which causes a problem in the system using a two-component developer, can be supplemented with the existence of the reverse polarity particles.

That is, since the consumption of the reverse polarity particles can be suppressed without causing the image memory phenomenon, even in a case where an image formation with a relatively small imaging area ratio is conducted continuously, the reverse polarity particles can supplement the electrically-charging ability of carrier effectively. Therefore, it is possible to provide a developing device and an image forming apparatus in which the electrically charged amount of toner is stabilized for a long period of time and a high quality image can be obtained over a long period of time without the problem of an image memory phenomenon.

The ability to move the reverse polarity particles in the present invention represents an ability to separate the reverse polarity particles contained in the developer from the developer in the toner supplying region 7 or the toner recovering region 8 and to move the separated reverse polarity particles to the side of the toner carrying member 25 or the side of the supply-developer carrying member 11.

When an AC voltage is applied by bias power sources 51 and 52 between the toner carrying member 25 and the supply-developer carrying member 11 and between the toner carrying member 25 and the recovery-developer carrying member 26, it is desirable to satisfy a relation of the following formula (1).

$$(C1\times V1pp\times d1\times f1)/(C2\times V2pp\times d2\times f2)>1 \quad (1)$$

Here, V1pp represents the absolute value of a difference between the maximum and the minimum of the AC voltage applied between the toner carrying member 25 and the supply-developer carrying members 11, f1 represents a frequency, d1 represents a shortest distance between the toner carrying member 25 and the supply-developer carrying member 11, C1 represents an electrostatic capacitance on the condition where there is no developer between the toner carrying member 25 and the supply-developer carrying members 11;

V2pp represents the absolute value of a difference between the maximum and the minimum of the AC voltage applied between the toner carrying member 25 and the recovery-developer carrying members 26, f2 represents a frequency, d2 represents a shortest distance between the toner carrying member 25 and the recovery-developer carrying members 26, and C2 represents an electrostatic capacitance on the condition where there is no developer between the toner carrying member 25 and the recovery-developer carrying members 26.

With this relationship, it is possible to make the ability to move the reverse polarity particles to the side of the supply-developer carrying member 11 in the toner feed region 7 to be larger than the ability to move the reverse polarity particles to the side of the toner carrying member 25 in the toner recovering region 8. Therefore, the reverse polarity particles charged to be the reverse polarity against the charged polarity of toner can fully be collected to the side of the supply-developer carrying member without causing an image memory phenomenon. As a result, the consumption of reverse polarity particles can be suppressed, the electrically charged amount of toner can be stabilized for a long period, and the high quality image can be formed over a long period of time without causing an image memory phenomenon.

In this connection, electrostatic capacitances C1 and C2 in Formula (1) and Formula (2) are values measured by the use of a LCR meter on the condition where there is no developer.

When a DC voltage is applied by bias power sources 51 and 52 between the toner carrying member 25 and the supply-developer carrying member 11 and between the toner carrying member 25 and the recovery-developer carrying member 26, it is desirable to satisfy a relation of the following formula (2).

$$(C1\times V1)/(C2\times V2)>1 \quad (2)$$

Here, V1 represents a voltage difference between the toner carrying member 25 and the supply-developer carrying member 11 in the direction to supply toner to the toner carrying member 25, C1 represents an electrostatic capacitance on a condition where there is no developer between the toner carrying member 25 and the supply-developer carrying member V2 represents a voltage difference between the toner carrying member 25 and the recovery-developer carrying member 26 in the direction to recovery toner to recovery-developer carrying member 26, and C2 represents an electrostatic capacitance on a condition where there is no developer between the toner carrying member 25 and the recovery-developer carrying member 26.

With this relationship, it is possible to make the ability to move the reverse polarity particles to the side of the supply-developer carrying member 11 in the toner feed region 7 to be larger than the ability to move the reverse polarity particles to the side of the toner carrying member 25 in the toner recovering region 8. Therefore, the reverse polarity particles charged to be the reverse polarity against the charged polarity of toner can fully be collected to the side of the supply-developer carrying member without causing an image memory phenomenon. As a result, the consumption of reverse polarity particles can be suppressed, the electrically charged amount of toner can be stabilized for a long period, and the high quality image can be formed over a long period of time without causing an image memory phenomenon.

Moreover, it is desirable to apply an alternating electric field between the toner carrying member 25 and the supply-developer carrying member 11 and to apply a direct current voltage between the toner carrying member 25 and the recovery-developer carrying member 26. The case to apply an alternating electric field between the toner carrying member 25 and the supply-developer carrying member 11 can make an ability to separate and move the reverse polarity particles larger than the case to apply a direct current voltage between the toner carrying member 25 and the recovery-developer carrying member 29.

With is setting, the reverse polarity particles charged to be the reverse polarity against the charged polarity of toner can fully be collected to the side of the supply-developer carrying member without causing an image memory phenomenon. As a result, the consumption of reverse polarity particles can be suppressed, the electrically charged amount of toner can be stabilized for a long period, and the high quality image can be formed over a long period of time without causing an image memory phenomenon.

In this embodiment, developer 24 contains toner, carrier to electrically charge the toner and reverse polarity particles. As an electrically charged polarity in the developer, the reverse polarity particles may be charged with the reverse polarity to the electrically charged polarity of the toner.

The reverse polarity particles used preferably in the embodiment are suitably chosen in accordance with the electrically charged polarity of the toner. When a negatively chargeable toner is used as the toner, positively chargeable particles are preferably used as the reverse polarity particles. As the positively chargeable particles, inorganic particles, such as barium titanate and alumina; thermoplastic resins, such as an acrylic resin, benzoguanamine resin, nylon resin, polyimide resin, and polyamide resin; and particles made of thermosetting resins may be employed. Further, resin containing a positive charge controlling agent to provide a positively chargeable property and resin made of a copolymer containing a nitrogen-containing monomer may be employed. Moreover, positively chargeable particles obtained by a surface treatment to provide a positively chargeable property on the surface of negatively-chargeable particles may be employed.

On the other hand, when a positively chargeable toner is used as the toner, negatively chargeable particles are preferably used as the reverse polarity particles. For example, in addition to inorganic particles, such as silica and titanium oxide; particles made of thermoplastic such as fluororesin, polyolefin resin, silicone resin, and polyester resin, or thermosetting resins may be usable. Further, resin containing a negative charge controlling agent to provide a negatively chargeable property or resin made of a copolymer of fluorine-containing acrylic type monomer or fluorine-containing methacrylic type monomer may be employed. Moreover, negatively chargeable particles obtained by a surface treatment to provide a negatively chargeable property on the surface of negatively chargeable particles may be employed.

Moreover, in order to control an electrically chargeable property and hydrophobicity of reverse polarity particles, the surface of inorganic particles may be subjected to a surface treatment with a silane coupling agent, a titanium coupling agent, silicone oil and so on. Especially, when inorganic particles are provided with a positively chargeable property, it is desirable to carry out a surface treatment with an amino group-containing coupling agent. In contrast, when inorganic particles are provided with a negatively chargeable property, it is desirable to carry out a surface treatment with an fluorine group-containing coupling agent.

The number average particle diameter of reverse polarity particles may be desirably 100 to 1000 nm.

Toner is not specifically limited, and well-known toner being currently generally used may be used as the toner. Further, toner which contains colorant and, if needed, a charge controlling agent and a release agent in binder resin and is processed with an external agent may be usable. Although toner particle size is not specifically limited, the number average particle diameter of the toner is desirably about 3 to 15 μm.

In manufacturing such the toner, it can be manufactured by a well-known method being currently generally used, for example, it can be manufactured by the use of a grinding method, an emulsion polymerization method, a suspension polymerization method, and so on.

Examples of binder resin used for the toner, although not limited to these, include styrene type resin (single polymer or copolymer containing styrene or styrene substitute), polyester resin, epoxy system resin, vinyl chloride resin, phenol resin, polyethylene resin, polypropylene resin, polyurethane resin, silicone resin, and so on. By the use of a single substance or a complex substance of these resins or complexes, it is desirable to use binder resin having a softening temperature in a range of 80 to 160° C. or a binder resin having a glass transition point in a range of 50 to 75° C.

Moreover, a well-known colorant being currently generally used can be used. For example, carbon black, aniline black, activated carbon, magnetite, benzine yellow, permanent yellow, naphthol yellow, phthalocyanine blue, first sky-blue, ultra marine blue, rose bengal, laky red, etc. may be used. Generally, it may be desirable to use the colorant at a rate of from 2 to 20 parts by mass to 100 parts by mass of the above-mentioned binder resin.

Moreover, as the above-mentioned charge controlling agent, a well-known agent can be used. As a charge controlling agent for positively chargeable toner, for example, a nigrosine type dye, a quarternary ammonium salt type compound, a triphenylmethane type compound, an imidazole type compound, polyamine resin, and so on may be employed. As a charge controlling agent for negatively chargeable toner, for example, a metal (such as Cr, Co, aluminum, and Fe)-containing azo type dye, a salicylic acid metallic compound, an alkyl salicylic acid metallic compound, a Kerlix arene compound, and so on may be employed.

Moreover, as the above-mentioned release agent, a well-known agent being currently generally used also can be used. For example, polyethylene, polypropylene, carnauba wax, sazol wax, and so on may be employed solely or in combination of two or more kinds thereof. Generally, it is desirable to use the release agent at a rate of 0.1 to 10 parts by mass to 100 parts by mass of the above-mentioned binder resin.

Moreover, as the above-mentioned external additive, a well-known additive being currently generally used also can be used. In order to improve a fluidity, for example, inorganic particles, such as silica, titanium oxide, and aluminium oxide, and resin particles, such as acrylic resin, styrene resin, silicone resin, fluororesin, may be used. Especially, it is desirable to use an external additive subjected to a hydrophobing treatment with a silane coupling agent, a titanium coupling agent, silicone oil, and so on. And, it is preferable to add and use such a fluidity improving agent at a rate of 0.1 to 5 parts by mass to 100 parts by mass of the above-mentioned toner. The number average primary particle size of the external additive is desirably 10 to 100 nm.

The carrier is not especially limited, a well-known carrier being currently generally used can be used, and for example, a binder type carrier, a coat type carrier, and so on, may be used. Although a carrier particle size is not limited to this, the number average particle diameter of the carrier is preferably 15 to 100 μm.

The binder type carrier is a carrier in which magnetic substance particles are dispersed in binder resin, and electrically chargeable particles of positively or negatively chargeable property may be fixed on a carrier surface, or a surface coating layer may be provided on a carrier surface. The electrically chargeable property of the binder type carrier such as a polarity can be controlled by the material of the binder resin, electrically chargeable particles, and the kind of the surface coating layer.

As the binder resin used for the binder type carrier, by polystyrene system resin, for example, thermoplastic resins, such as vinyl type resin, polyester type resin, nylon type resin, and polyolefin type resin, and curable resins such as phenol resin may be exemplified.

As magnetic substance particles of the binder type carrier, for example, spinel ferrite, such as magnetite and γ-iron oxide; spinel ferrite containing two or more kinds of metals (Mn, nickel, Mg, Cu, etc.) other than iron; magnetoplumbite type ferrites, such as a barium ferrite; and particles of iron or alloy which has a layer of oxides may be used. The shape of the particles may be any one of grain and spherical and needlelike shape. When high magnetization is required especially, it is desirable to use iron type ferromagnetic particles. Moreover, when chemical stability is taken into consideration, it is desirable to use ferromagnetic particles such as spinel ferrite containing magnetite and γ-iron oxide and magnetoplumbite type ferrites, such as a barium ferrite. By the appropriate selection of the kind and content of the ferromagnetic particles, magnetic resin carrier having a desired magnetization can be obtained. It may be appropriate to add magnetic substance particles in a magnetic resin carrier in an amount of 50% to 90% by mass.

As a surface coat material of the binder type carrier, silicone resin, acrylic resin, epoxy resin, fluorine type resin, etc. may be employed, and these resin are coated and cured on a surface to form a coat layer, whereby electrical charge providing ability can be enhanced.

The fixation of electrically chargeable particles or conductive particles onto the surface of a binder type carrier is conducted in such a way that for example, magnetic resin carrier and particles are homogenously mixed so as to adhere these particles onto the surface of the magnetic resin carrier, and thereafter, the particles are fixed so as to be hit into the magnetic resin carrier by the application of mechanical and thermal impact force. In this case, particles are not thoroughly laid underground in the magnetic resin carrier, and are fixed such that a part of the particles protrude above from the surface of the magnetic resin carrier. An organic or inorganic insulating material may be used as the electrically chargeable particles. Concretely, as the organic type, for example, organic insulation particulates, such as polystyrene, styrene type copolymer, acrylic resin, various kinds of acrylic copolymer, nylon, polyethylene, polypropylene, fluororesin, and crosslinked materials of these may be employed. With regard to an electrically charged level and a polarity, a desired electrically charged level and polarity can be acquired by a material, a polymerization catalyst, a surface treatment, etc. Further, as the inorganic type, negatively chargeable inorganic particles, such as silica and a titanium dioxide; and positively chargeable inorganic particles, such as strontium titanate and alumina, etc. may be employed.

On the other hand, the coat type carrier is carrier in which a carrier core particle made of magnetic substances is coated with resin, and also in the coat type carrier as same with the binder type carrier, positively electrically chargeable particles of positively or negatively chargeable property can be fixed on the surface of carrier. The electrically chargeable property of the coat type carrier such as a polarity can be controlled by the kind of a surface coating layer and electrically chargeable particles, and the same material as that for the binder type carrier can be used for them. Especially, the same resin with the binder resin of the binder type carrier can be used as the coat resin.

Figure 2:
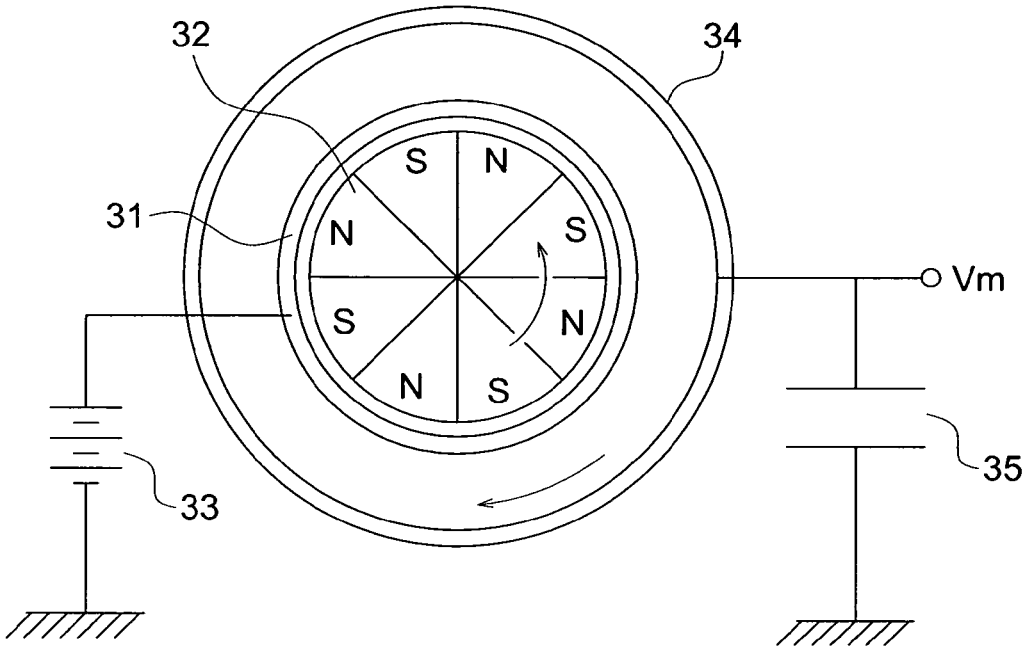
FIG. 2 is an outlined schematic diagram showing a measuring device of an electric charge amount.

After reverse polarity particles, toner and carrier are mixed and agitated so as to form a developer, respective electrically charged polarities of the reverse polarity particles and the toner in the combination of the reverse polarity particles, the toner and the carrier can be easily known from the direction of an electric field for separating the toner or the reverse polarity particles from the developer by the use of an apparatus shown in FIG. 2. First, the developer is made to be uniformly held on a surface of a conductive sleeve 31 by the magnetic force of a magnet roll 32, and after that, a metal electrode 34 is arranged in non-contact to the developer. Thereafter, the magnet roll 32 is rotated while a voltage is impressed to a metal sleeve by a power source 33, whereby particles having the same polarity of the impressed voltage fly to the metal electrode 34 by an electric field. The electrically charged polarity of the toner or the reverse polarity particles can be known when this operation is conducted while the polarity of the voltage is changed.

Although the mixture ratio of toner and carrier may be preferably adjusted so as to obtain the desired electrically charged amount of the toner, and a toner ratio is 3% to 50% by mass to the whole amount of the toner and the carrier, preferably 5% to 20% by mass although it depends on the ratio of the surface areas caused by a difference in particle diameter between toner and carrier.

The amount of the reverse polarity particles contained in a developer is not restricted especially as long as the object of the present invention is attained, for example, it is desirably 0.01 to 5.00 parts by mass to 100 parts by mass of carrier, more desirably 0.01 to 2.00 parts by mass.

After reverse polarity particles and toner are mixed beforehand, a developer may be prepared by mixing the mixture of the reverse polarity particles and the toner with carrier, for example.

A supply-developer carrying member 11 is structured with a magnet roller 13 arranged with a fixed arrangement and a sleeve roller 12 including a magnet roller 13 therein and being rotatable. The magnet roller 13 has five magnetic poles of N1, S1, N2, N3, and S2 along the rotation direction B of the sleeve roller 12. Among these poles, a main magnetic pole N1 is located at a position of a toner feed region 7 facing a toner carrying member 25. Further, the same polarity magnetic poles N2, N3 to generate a repelling field for scraping the developer 24 on the sleeve roller 12 are arranged at positions opposite to each other in a developer container 16.

A recovery-developer carrying member 26 is structured with a magnet roller 28 arranged with a fixed arrangement, and a sleeve roller 27 including this magnet roller 28 therein and being rotatable. The magnet roller 28 has five poles of S3, N5, S4, N6, and N4 along the rotation direction B of the sleeve roller 27. Among these magnetic poles, a main magnetic pole S3 is located at a position of a toner discovering section 8 facing the toner carrying member 25. Further, the same polarity magnetic poles N6, N4 to generate a repelling field for scraping the developer 24 on the sleeve roller 27 are arranged at positions opposite to each other in the developer container 16.

The developer container 16 is structure with a casing body 19, and usually accommodates therein a bucket roller 17 for feeding developer to the supply-developer carrying member 11. At a position on the casing body 19 facing the bucket roller 18, is preferably arranged an ATDC (Automatic Toner Density Control) sensor 20 for toner concentration detection.

The developing device 2 usually comprises a replenishing section 10 for replenishing toner of an amount consumed in a developing region 6 into the developer container 16 and a regulating member 15 (regulation blade) for making a developer to a thin layer and for regulating an amount of developer on the supply-developer carrying member 11. The replenishing section 10 is structure with a hopper storing replenishment toner 23 and a replenishing roller for replenishing toner into the developer container 16.

As the replenishment toner 23, It is desirable to use toner into which reverse polarity particles are added in the outside of the developer container 16. By the use of the toner added with the reverse polarity particles in the outside, it becomes possible to supplement effectively a decrease of electrically-chargeable property of the carrier which deteriorates gradually by durability. The amount of the reverse polarity particles added in the replenishing toner 23 at the outside is 0.1% to 10.0% by mass to the toner, especially desirably 0.5%-5.0% by mass.

A toner supply bias impressed between the toner carrying member 25 and the supply-developer carrying member 11 by a bias power source 51 becomes different depending on an electrically charged polarity of toner. When a negatively chargeable toner is used, an average voltage becomes positive at the side of the toner carrying member 25. On the other hand, when a positively chargeable toner is used, an average voltage becomes negative at the side of the toner carrying member 25. In any case where a negatively chargeable toner or a positively chargeable toner is used, an average voltage difference between the toner carrying member 25 and the supply-developer carrying member 11 is 20 to 500 V, preferably 50 to 300 V. If the voltage difference is too small, it becomes difficult to separate toner from carrier sufficiently. On the other hand, if the voltage difference is too large, carrier held on the supply-developer carrying member 11 by magnetic force may be separated by the electric field, causing a fear that an original developing function may be spoiled in the developing region.

Also, a toner recovery bias impressed between the toner carrying member 25 and the recovery-developer carrying member 26 by a bias power source 52 becomes different depending on an electrically charged polarity of toner. When a negatively chargeable toner is used, an average voltage becomes negative at the side of the toner carrying member 25. On the other hand, when a positively chargeable toner is used, an average voltage becomes positive at the side of the toner carrying member 25. In any case where a negatively chargeable toner or a positively chargeable toner is used, an average voltage difference between the toner carrying member 25 and the recovery-developer carrying member 26 is 20 to 500 V, preferably 50 to 300 V. If the voltage difference is too small, it becomes difficult to separate toner from the surface of the toner carrying member 25 sufficiently. On the other hand, if the voltage difference is too large, carrier held on the recovery-developer carrying member 26 by magnetic force may be separated by the electric field, causing a fear that an original developing function may be spoiled in the developing region.

The toner carrying member 25 and the image carrying member 1 may come in contact with each other, or may come in non-contact. A gap in non-contact is preferably 0.1 to 0.5 mm and a bias impressed by the bias power source 53 is preferably an AC bias of about 0.5-3 kv and a frequency of 500 Hz to 4 kHz.

The toner carrying member 25 may be made of any kind of material as long as the above-mentioned voltage can be impressed, for example, an aluminum roller applied with a surface treatment may be listed. In addition, as the toner carrying member 25, may be used a member in which on a conductive base, such as aluminum, is applied, for example, a resin coat, such as polyester resin, polycarbonate resin, acrylic resin, polyethylene resin, polypropylene resin, urethane resin, polyamide resin, polyimide resin, polysulfone resin, polyether ketone resin, vinyl chloride resin, vinyl acetate resin, silicone resin, and fluororesin; or a rubber coating, such as silicone rubber, polyurethane rubber, nitrile rubber, crude rubber, and polyisoprene rubber. As the coating material, it is not limited to these. Furthermore, a conductive agent may be added into the bulk of the above-mentioned coating or on the surface of the above-mentioned coating. As a conductive agent, an electronic conductive agent or an ion conductive agent may be listed. Examples of the electronic conductive agent, without being restrained them, include carbon black, such as Ketzin black, acetylene black, and furnace black, particles of metal powder and a metal oxide, etc. may be listed. Although a cationic compound, such as quarternary ammonium salt, an amphoteric compound, and other ionic polymer materials may be listed as the ion conductive agent, it does not adhere to these materials. Furthermore, the toner carrying member 25 may be a conductive roller made of a metallic material, such as aluminum.

The image carrying member 1 is a member in which a under coated layer and a photosensitive layer are formed in this order on an aluminium cylindrical base body, and the photosensitive layers may be a function separating type structured with a charge generating layer and successively a charge transport layers, or may be a single layer structure in which charge generating material and charge transporting material are dispersed into resin. Hereafter, the function separating type photoreceptor will be explained.

First, the charge generating layer is formed on conductive support. The charge generating layer may be formed by a method of making a charge generating material vacuum evaporation, a method of dissolving a charge generating material in an amine type solvent, coating the solution, and drying it, or a method of dispersing a charge generating material in a suitable solvent or a solution in which binder resin is dissolved when required, coating the coating solution produced by the above dispersing and drying the coating. The thickness of the charge generating layer is preferably 0.01 to 5 μm, more preferably 0.1 to 2 μm.

Subsequently, the charge transporting layer is formed. The charge transporting layer may be formed by a method of coating a coating liquid containing at least a charge transporting material, a binder resin, and an organic solvent on the above-mentioned charge generating layer, and drying the coating liquid. The thickness of the first charge transporting layer is preferably 4 to 50 μm, more preferably 10 to 20 μm.

EXAMPLE

Hereafter, an example of a developing device applicable to the present invention in an image forming apparatus employing an electrophotography method will be explained.

Examples 1 to 7

Comparative Examples 1 to 11

A printing endurance test was conducted by the use of a developing device and an image forming apparatus which have the structures shown in FIG. 1. As a developer, carrier for Konica Minolta Business Technologies bizhub C350 (volume average particle diameter of about 33 μm) and toner manufactured by the following processes were used. The toner manufacturing method is that into 100 parts by mass of a toner base-material produced by a wet granulating method and having a volume average particle diameter of about 6.5 μm; 0.6 parts by mass of hydrophobic silica applied with a surface treatment with a hydrophobing agent of hexamethyldisilazane (HMDS) and having a number average primary particle size of 20 nm as an external additive "a" and 0.5 parts by mass of hydrophobic titanium oxide obtained by the application of a surface treatment onto an anatase type titanium oxide having a number average primary particle size of 30 nm with a hydrophobing agent of isobutyl trimethoxysilane in a water based wet type as an external additive "b" are externally added at a rate of 40 m/s for two minutes by the use of Henschel mixer (made by a Mitsui Mining company). Further, into the toner applied with the above external addition process, strontium titanate applied with a surface treatment and having a number average particle diameter of 350 nm was added as reverse polarity particles. As the surface preparation for the reverse polarity particles, fluorine-modified silicone oil was processed with an added amount of 1.6 parts by masses to 100 parts by masses of a mother material of the reverse polarity particles with a dry process. Here, the dry process was a process of diluting a hydrophobing agent with a solvent, adding the above-mentioned diluted solution to reverse polarity particles, mixing them, heating and drying this mixture and thereafter cracking the dried mixture. The toner was obtained such that these reverse polarity particle were added at a rate of 2 parts by masses to 100 parts by mass of the mother material of toner and were applied with an externally adding process for 20 minutes at the rate of 40 m/s by the use of a Henschel mixer. Incidentally, a toner ratio in a developer was made to 8% by mass. However, the toner ratio is a ratio of the whole amount of the toner, a post treatment agent and the reverse polarity particles to the whole quantity of developer.

As the toner carrying member 25, a toner carrying member made of aluminium and having a diameter of 18 mm and a surface applied with an alumite treatment was used. The toner carrying member 25 was arranged in non-contact with the image carrying member with a gap of 0.16 mm. As the bias between the image carrying member 1 and the toner carrying member 25, a bias in which an AC component (a square wave, a wave peak value of 1.4 kVpp, a frequency of 2 kHz, a duty ratio of 50%) was superimposed on a DC component (−400 V) was used.

A system rate was set at 150 mm/sec, a rate ratio θ of the toner carrying member 25 to the image carrying member 1 was set at 1.5, and a rate ratio θ of the supply-developer carrying member 11 and the recovery-developer carrying member 26 to the image carrying member 1 was set at 2.

The supply-developer carrying member 11 (supplying roller) and the recovery-developer carrying member 26 (recovering roller) were a magnet roller including magnetic poles therein shown in FIG. 1. In Examples 1 to 7 and Comparative examples 1 to 11, the sleeve diameter, a gap for the toner carrying member and a bias condition were adjusted as shown in Table 1. In this connection, when the direct voltage was applied onto the supply-developer carrying member 11, a voltage difference was formed in a direction to supply toner to the toner carrying member 25. On the other hand, when the direct voltage was applied onto the recovery-developer carrying member 26, a voltage difference was formed in a direction to recover toner to the recovery-developer carrying member 25.

Moreover, an electrostatic capacitance C1 between the toner carrying member 25 and the supply-developer carrying member 11 and an electrostatic capacitance C2 between the toner carrying member 25 and the recovery-developer carrying member 26 in each of Examples and Comparative examples were measured on the condition where there was no developer. The values of Formula (1) and Formula (2) were calculated from these measurement results and the conditions shown Table 1. The calculation result of Formula (1) and Formula (2) and the measurement results of the electrostatic capacitance are shown in Table 1.

Moreover, the situation of image deterioration during the printing endurance test is also shown in Table 1. In Table 1, toner fogging in a background portion during the printing endurance test was observed by visual observation.

The evaluation criterions were determined as follows:

"A" represents that no fogging was observed.

"B" represents that fogging was slightly observed.

"C" represents that fogging was observed with a level not to cause a problem.

"D" represents that fogging was observed with a level to cause a problem.

An "A-4" size print sheet was printed lengthwise during the printing endurance test, and $50000^{th}$ print sheet and $100000^{th}$ print sheet were evaluated with regard to fogging. From the evaluation of this fogging, the deterioration degree of toner electrically-charging ability of carrier can be predicted. Moreover, the problem of the image memory phenomenon was no observed in Examples and Comparative examples. This is because with the structure in which the recovery-developer carrying member 26 was arranged, toner on the toner carrying member 25 after development by was recovered by the recovery-developer carrying member 26, whereby a memory pattern corresponding to a toner-consumed portion on the toner carrying member 25 was eliminated.

TABLE 1

| | Supplying roller | | | | | | Recovering roller | | | | | | | Values in | Result | |
|---|---|---|---|---|---|---|---|---|---|---|---|---|---|---|---|---|
| | | | | Alternate voltage | | | | | | Alternate voltage | | | | | | |
| | *1 | Gap d1 (mm) | *2 V1 (v) | V1pp (v) | f1 (kHz) | *3 C1 (pF) | *1 | Gap d2 (mm) | *2 V2 (v) | V2pp (v) | f2 (kHz) | *3 C2 (pF) | Formula (1) or (2) | 50 thousandth sheet | 100 thousandth sheet |
| ** 1 | 25 | 0.35 | 200 | 0 | 0 | 14.3 | 12 | 0.35 | 200 | 0 | 0 | 12.4 | 1.15 | A | A |
| ** 2 | 25 | 0.35 | 200 | 0 | 0 | 14.3 | 12 | 0.35 | 230 | 0 | 0 | 12.4 | 1.00 | A | B |
| Comp. 1 | 25 | 0.35 | 200 | 0 | 0 | 14.3 | 12 | 0.35 | 260 | 0 | 0 | 12.4 | 0.89 | A | C |
| Comp. 2 | 12 | 0.5 | 200 | 0 | 0 | 9.3 | 25 | 0.5 | 200 | 0 | 0 | 11.3 | 0.82 | B | C |
| Comp. 3 | 12 | 0.5 | 230 | 0 | 0 | 9.3 | 25 | 0.5 | 200 | 0 | 0 | 11.3 | 0.95 | A | C |
| ** 3 | 12 | 0.5 | 260 | 0 | 0 | 9.3 | 25 | 0.5 | 200 | 0 | 0 | 11.3 | 1.07 | A | A |
| Comp. 4 | 12 | 0.35 | 200 | 0 | 0 | 12.4 | 25 | 0.35 | 200 | 0 | 0 | 14.3 | 0.87 | B | C |
| ** 4 | 25 | 0.35 | 150 | 600 | 2 | 14.3 | 25 | 0.35 | 150 | 550 | 2 | 14.3 | 1.09 | A | A |
| Comp. 5 | 25 | 0.35 | 150 | 600 | 2 | 14.3 | 25 | 0.35 | 150 | 650 | 2 | 14.3 | 0.92 | A | C |
| Comp. 6 | 25 | 0.35 | 150 | 600 | 2 | 14.3 | 25 | 0.35 | 150 | 700 | 2 | 14.3 | 0.86 | B | C |
| Comp. 7 | 12 | 0.35 | 150 | 600 | 2 | 12.4 | 25 | 0.35 | 150 | 550 | 2 | 14.3 | 0.95 | A | C |
| ** 5 | 25 | 0.35 | 150 | 750 | 2 | 14.3 | 25 | 0.35 | 150 | 700 | 2 | 14.3 | 1.07 | A | A |
| ** 6 | 25 | 0.35 | 150 | 600 | 3 | 14.3 | 25 | 0.35 | 150 | 700 | 2 | 14.3 | 1.29 | A | A |
| Comp. 8 | 25 | 0.35 | 150 | 600 | 2 | 14.3 | 25 | 0.35 | 150 | 550 | 3 | 14.3 | 0.73 | B | C |
| ** 7 | 12 | 0.35 | 150 | 600 | 2 | 12.4 | 12 | 0.35 | 150 | 550 | 2 | 12.4 | 1.09 | A | A |
| Comp. 9 | 12 | 0.35 | 150 | 600 | 2 | 12.4 | 25 | 0.35 | 150 | 550 | 2 | 14.3 | 0.95 | A | C |
| ** 8 | 25 | 0.45 | 150 | 600 | 2 | 12.8 | 25 | 0.35 | 150 | 550 | 2 | 14.3 | 1.26 | A | A |
| Comp. 10 | 12 | 0.35 | 150 | 600 | 2 | 12.4 | 25 | 0.45 | 150 | 550 | 2 | 12.8 | 0.82 | B | C |
| ** 9 | 12 | 0.5 | 200 | 400 | 1 | 9.3 | 25 | 0.5 | 200 | 0 | 0 | 11.3 | — | A | A |
| Comp.11 | 12 | 0.5 | 200 | 0 | 0 | 9.3 | 25 | 0.5 | 200 | 400 | 1 | 11.3 | — | C | C |

*1: Diameter (mm),
*2: Direct current voltage,
*3: Electrostatic capacitor
Comp.: Comparative example,
: Example It can be understood from the results shown in Table 1 that when the ability to move the reverse polarity particles to the side of the supply-developer carrying member 11 in the toner feed region 7 is made larger than the ability to move the reverse polarity particles to the side of the toner carrying member 25 in the toner recovering region 8**, the consumption of reverse polarity particles is suppressed and toner charging can be conducted stably over a long period of time.

In particular, it can be said from Examples 1 to 3 and Comparative examples 1 to 4 that when a DC voltage is applied by the bias power sources 51 and 52 between the toner carrying member 25 and the supply-developer carrying member 11 and between the toner carrying member 25 and the recovery-developer carrying member 26, it is desirable to satisfy a relation of the following formula (2).

$$(C1\times V1)/(C2\times V2)>1 \quad (2)$$

Further, it can be said from Examples 4 to 8 and Comparative examples 5 to 10 that when an AC voltage is applied by the bias power sources 51 and 52 between the toner carrying member 25 and the supply-developer carrying member 11 and between the toner carrying member 25 and the recovery-developer carrying member 26, it is desirable to satisfy a relation of the following formula (1).

$$(C1\times V1pp\times d1\times f1)/(C2\times V2pp\times d2\times f2)>1 \quad (1)$$

Moreover, it can be said from Example 9 and Comparative example 10 that it is desirable to apply an alternating electric field between the toner carrying member 25 and the supply-developer carrying member 11 and to apply a direct current voltage between the toner carrying member 25 and the recovery-developer carrying member 26.

What is claimed is:

1. An image forming apparatus, comprising:

an image carrying member to carry an electrostatic latent image;

a developer container to accommodate developer, the developer comprising: toner, carrier to electrically charge the toner and having magnetism, and reverse polarity particles electrically chargeable with a reverse polarity against the electrically charged polarity of the toner and different from the carrier;

a toner carrying member to carry toner to a developing region arranged opposite to the image carrying member in order to develop the electrostatic latent image on the image carrying member with the toner;

a first developer carrying member arranged opposite to the toner carrying member so as to carry developer fed from the developer container and to supply toner to the toner carrying member, wherein the first developer carrying member comprises a first magnet therein to hold the developer via the carrier, wherein the toner and reverse polarity particles are movable relative to the carrier and are movable to the toner carrying member;

second developer carrying member arranged opposite to the toner carrying member at a position of an upstream side of the first developer carrying member in terms of the toner conveying direction of the toner carrying member so as to carry developer and to recover toner on the toner carrying member, wherein the second developer carrying member comprises a second magnet therein to hold the developer via the carrier;

wherein an ability to move the reverse polarity particles from the toner carrying member to the first developer carrying member is larger than an ability to move the reverse polarity particles from the second developer carrying member to the toner carrying member.

2. The image forming apparatus described in claim 1, wherein a number average particle size of the reverse polarity particles is 100 nm to 1000 nm.

3. The image forming apparatus described in claim 1, further comprising: a replenishing device to replenish toner added externally with reverse polarity particles to the developer container.

4. The image forming apparatus described in claim 1, further comprising: a first voltage applying section to apply a first alternate voltage between the toner carrying member and the first developer carrying member; and a second voltage applying section to apply a second alternate voltage between the toner carrying member and the second developer carrying member.

5. The image forming apparatus described in claim 4, wherein the image forming apparatus satisfies the following formula:

$$(C1\times V1pp\times d1\times f1)/(C2\times V2pp\times d2\times f2)>1$$

where C1 represents an electrostatic capacitance on the condition where there is no developer between the toner carrying member and the first developer carrying member; V1pp represents the absolute value of a difference between the maximum value and the minimum value of the first alternate voltage;

f1 represents the frequency of the first alternate voltage;

d1 represents the shortest distance between the toner carrying member and the first developer carrying member;

C2 represents an electrostatic capacitance on the condition where there is no developer between the toner carrying member and the second developer carrying member;

V2pp represents the absolute value of a difference between the maximum value and the minimum value of the second alternate voltage;

f2 represents the frequency of the second alternate voltage; and d2 represents the shortest distance between the toner carrying member and the second developer carrying member.

6. The image forming apparatus described in claim 1, further comprising: a first voltage applying section to apply an alternate voltage between the toner carrying member and the first developer carrying member; and a second voltage applying section to apply a direct current voltage between the toner carrying member and the second developer carrying member.

7. The image forming apparatus described in claim 1, further comprising: a first voltage applying section to apply a first direct current voltage between the toner carrying member and the first developer carrying member in a direction to supply toner to the toner carrying member; and a second voltage applying section to apply a second direct current voltage between the toner carrying member and the second developer carrying member in a direction to recovery toner to the second developer carrying member.

8. The image forming apparatus described in claim 7, wherein the image forming apparatus satisfies the following formula:

$$(C1\times V1)/(C2\times V2)>1$$

where C1 represents an electrostatic capacitance on the condition where there is no developer between the toner carrying member and the first developer carrying members;

V1 represents a voltage difference between the toner carrying member and the first developer carrying members;

C2 represents an electrostatic capacitance on the condition where there is no developer between the toner carrying member and the second developer carrying members; and V2 represents a voltage difference between the toner carrying member and the second developer carrying members.

9. An image forming method, comprising:

accommodating developer, wherein the developer comprises: toner, carrier to electrically charge the toner and, having magnetism and reverse polarity particles electrically chargeable with a reverse polarity against the electrically charged polarity of the toner in a developer container and different from the carrier;

forming an electrostatic latent image on an image carrying member;

holding, via the carrier, the developer accommodated in the developer container on a first developer carrying member comprising a first magnet therein and conveying the developer to a supply region arranged opposite to a toner carrying member, wherein the toner and reverse polarity particles are movable relative to the carrier and are movable to the toner carrying member;

supplying toner from the developer held on the first developing carrying member on the supply region while moving reverse polarity particles existing on the toner carrying member to the first developer carrying member;

conveying the toner supplied onto the toner carrying member on the supply region to a development region arranged opposite to the image carrying member and developing the electrostatic latent image on the image carrying member with toner;

conveying the toner which is held on the toner carrying member and has passed through the development region, to a recovery region arranged opposite to a second developer carrying member comprising a second magnet therein to hold the developer via the carrier, and recovering the toner held on the toner carrying member onto the second developer carrying member on the recovery region while moving reverse polarity particles existing on the second developer carrying member to the toner carrying member;

wherein an ability to move the reverse polarity particles from the toner carrying member to the first developer carrying member is larger than an ability to move the reverse polarity particles from the second developer carrying member to the toner carrying member.

10. The developing method described in claim 9, further comprising:

applying a first alternate voltage between the toner carrying member and the first developer carrying member; and applying a second alternate voltage between the toner carrying member and the second developer carrying member;

wherein the image forming method satisfies the following formula:

$$(C1\times V1pp\times d1\times f1)/(C2\times V2pp\times d2\times f2)>1$$

where C1 represents an electrostatic capacitance on the condition where there is no developer between the toner carrying member and the first developer carrying member;

V1pp represents the absolute value of a difference between the maximum value and the minimum value of the first alternate voltage;

f1 represents the frequency of the first alternate voltage;

d1 represents the shortest distance between the toner carrying member and the first developer carrying member;

C2 represents an electrostatic capacitance on the condition where there is no developer between the toner carrying member and the second developer carrying member;

V2pp represents the absolute value of a difference between the maximum value and the minimum value of the second alternate voltage;

f2 represents the frequency of the second alternate voltage; and d2 represents the shortest distance between the toner carrying member and the second developer carrying member.

11. The developing method described in claim 9, further comprising the steps of: applying an alternate voltage between the toner carrying member and the first developer carrying member; and applying a direct current voltage between the toner carrying member and the second developer carrying member.

12. The developing method described in claim 9, further comprising the steps of: applying a first direct current voltage between the toner carrying member and the first developer carrying member in a direction to supply toner to the toner carrying member; and applying a second direct current voltage between the toner carrying member and the second developer carrying member in a direction to recovery toner to the second developer carrying member; wherein the image forming method satisfies the following formula:

$$(C1 \times V1)/(C2 \times V2) > 1$$

where C1 represents electrostatic capacitance on the condition where there is no developer between the toner carrying member and the first developer carrying members;

V1 represents a voltage difference between the toner carrying member and the first developer carrying members;

C2 represents an electrostatic capacitance on the condition where there is no developer between the toner carrying member and the second developer carrying members; and V2 represents a voltage difference between the toner carrying member and the second developer carrying members.

* * * * *